US011492884B2

(12) United States Patent
Liu et al.

(10) Patent No.: US 11,492,884 B2
(45) Date of Patent: Nov. 8, 2022

(54) PRODUCTION METHOD FOR METHANE HYDRATE USING RESERVOIR GROUTING

(71) Applicants: Japan E&P International Corporation, Tokyo (JP); Waseda University, Tokyo (JP)

(72) Inventors: Yuchen Liu, Tokyo (JP); Masanori Kurihara, Tokyo (JP)

(73) Assignees: Japan E&P International Corporation, Tokyo (JP); Waseda University, Tokyo (JP)

( * ) Notice: Subject to any disclaimer, the term of this patent is extended or adjusted under 35 U.S.C. 154(b) by 0 days.

(21) Appl. No.: 17/256,014

(22) PCT Filed: Sep. 11, 2018

(86) PCT No.: PCT/JP2018/033532
§ 371 (c)(1),
(2) Date: Dec. 24, 2020

(87) PCT Pub. No.: WO2020/003551
PCT Pub. Date: Jan. 2, 2020

(65) Prior Publication Data

US 2021/0222536 A1 Jul. 22, 2021

(30) Foreign Application Priority Data

Jun. 25, 2018 (JP) ..... JP2018-119449

(51) Int. Cl.
*E21B 43/26* (2006.01)
*C10L 3/10* (2006.01)
(Continued)

(52) U.S. Cl.
CPC ..... *E21B 43/26* (2013.01); *C10L 3/108* (2013.01); *E21B 43/16* (2013.01)

(58) Field of Classification Search
CPC ..... E21B 43/24; E21B 36/00; E21B 43/295; E21B 17/18; E21B 43/01; E21B 43/00; E21B 43/16; E21B 29/02
See application file for complete search history.

(56) References Cited

U.S. PATENT DOCUMENTS 7,404,441 B2 * 7/2008 Hocking ..... E21B 43/261 166/305.1
2005/0103498 A1 * 5/2005 Yemington ..... E21B 17/18 166/302

FOREIGN PATENT DOCUMENTS

JP 2009030378 A 2/2009
JP 2011012451 A 1/2011

OTHER PUBLICATIONS

Koji Yamamoto, "Development method of methane hydrate resource", International Symposium on Methane Hydrate Resources, Nov. 17, 2010.

(Continued)

*Primary Examiner* — Zakiya W Bates

(57) ABSTRACT

A methane hydrate production method comprising a step of performing a reservoir grouting process. The reservoir grouting process comprises: injecting a grouting agent into a frozen soil reservoir on the land or a seabed reservoir for targeting methane hydrate existing within sand particles of the target reservoirs; or injecting a filling material into cavities naturally or artificially occurred in a frozen soil reservoir on the land or a seabed reservoir for targeting methane hydrate existing within sand particles of the target reservoirs, and enabling a grouting body being constructed.

14 Claims, 9 Drawing Sheets

(1)

(2)

(51) Int. Cl.
*E21B 43/16* (2006.01)
*E21B 33/138* (2006.01)

(56) References Cited

OTHER PUBLICATIONS

Research Consortium for Methane Hydrate Resources in Japan, "Report on the Results of the First Marine Yielding Trial", Ministry of Economy, Trade and Industry, Methane Hydrate Development Implementation Study Conference (The eighth series), 2007.
Koji Yamamoto, Methane Hydrate Resource Development and Research Consortium, "Report on the Second Marine Yielding Trial", Methane Hydrate Forum, Nov. 29, 2017.

* cited by examiner (1)

Before injecting (2)

After injecting (2)

(1)

(1)

(2)

(1)

(2)

(3)

(1)

Transporting (2)

After solidified (1) Before constructing (2) Pre-processing (3) During constructing

PRODUCTION METHOD FOR METHANE HYDRATE USING RESERVOIR GROUTING

TECHNICAL FIELD

The present invention relates to a yielding method of sand reservoir type methane hydrate existing in a frozen soil reservoir on the land, a subsea reservoir and the like.

BACKGROUND ART

Methane hydrate is attracting worldwide attention as a next-generation energy resource, and various development methods are being studied by research teams in various countries (Patent Literature 1) (Patent Literature 2). Until now, Japanese researchers have already conducted several field yielding trials and been able to verify that a depressurization method is effective as a method for decomposing methane hydrate (Non-patent Literature 1).

However, in field yielding trials conducted in Japan or other foreign countries in the past, there are problems of both of compaction of reservoir and production of sand, and both are considered to be the biggest hurdle to overcome for achieving a stable production of methane hydrate (Non-patent Literature 2). This is because solid methane hydrate exists in the reservoir composed of sand particles that are unsolidified or weakly solidified, and the solid methane hydrate also plays a role of supporting the sand particles by filling the pores between the particles. On the other hand, when methane hydrate is decomposed into methane gas and water, the adhesion force within the sand particles will be deprived and resulting in fluidity. The fluidized sand will be carried into the mine due to the occurrence of water or gas, and it will damage the equipment in the mine.

In order to avoid production obstacles due to production of sand, the gravel pack screen method, which has a practical effectiveness in conventional petroleum oil and gas production, was introduced in the latest second marine yielding trial. However, this approach simply filters out the outflowed sand, and cannot suppress the occurrence of the fluidity of the sand, and its effect is extremely limited as a countermeasure against production of sand in methane hydrate production. The inadequacy is clarified by the same yielding trial (Non-patent Literature 3).

CITATION LIST

Patent Literature

[Patent Literature 1] Japanese Patent Application Laid-Open No. 2009-030378

[Patent Literature 2] Japanese Patent Application Laid-Open No. 2011-012451

Non-Patent Literature

[Non-patent Literature 1] Koji Yamamoto, "Development method of methane hydrate resource", International Symposium on Development of Methane Hydrate Resources, 2010.

[Non-patent Literature 2] Methane Hydrate Resource Development and Research Consortium, "Report on the Results of the First Marine Yielding Trial", Ministry of Economy, Trade and Industry, Methane Hydrate Development Implementation Study Conference (The eighth series), 2007.

[Non-patent Literature 3] Methane Hydrate Resource Development and Research Consortium, "Report on the Second Marine Yielding Trial", Methane Hydrate Forum, 2017

SUMMARY OF INVENTION

Technical Problem

In the conventional yielding method, there are existing problems so-called "compaction of reservoir" and "production of sand". An innovative methane hydrate yielding method is provided by the present invention, which can solve the problems of the compaction of reservoir and the production of sand.

The present invention is a yielding method comprising the following steps (a) to (e) for targeting a sand reservoir type methane hydrate existing between the sand particles of a frozen soil reservoir on the land or a subsea reservoir.

(a) A reservoir grouting process of injecting grouting agent or a filling material into the methane hydrate reservoir to be developed.

(b) Prior to the reservoir grouting process (a), a planning process of calculating and determining the type of injected grouting agent, operation method and conditions, various parameters, etc.

(c) After the reservoir grouting process (a), a production process of recovering methane gas by decomposing methane hydrate into methane gas and water from the reservoir that has undergone the reservoir grouting.

(d) After the reservoir grouting process (a) and prior to the production process, if necessary, a hydraulic fracturing and chemical treatment process for improving the reservoir permeation rate of the grouted reservoir that has undergone the reservoir grouting.

(e) After the planning process (b) and prior to the reservoir grouting process (a), a pretreatment process of intentionally raising production of sand in advance by constructing a cavity, in order to construct a space for constructing a grouting body through the filling material.

Within the above-mentioned processes (a) to (e), in order to maximize economic efficiency, it is possible to omit some processes, to carry out some processes several times, or to change implementing procedure.

Preferably, the grouting agent is selected from those capable of sufficiently adhering sand particles with weak solidification constituting the reservoir within a range where the permeability of the reservoir will not largely decrease. For example, it can be selected from those are capable of adhering the sand particles, via the formation of precipitates, polymers, and other solids, including cement, water glass, polymers (acrylamide type, epoxy resin, phenol resin, furan resin, urea type, urethane type, etc.), or calcium carbonate.

Preferably, the filling material is selected from those capable of constructing a grouting body with sufficient strength and good permeability, which is constructed by filling the filling material into cavities, resulted from natural or artificial production of sand. For example, it can be selected from resin-coated sand, resin-coated ceramic particles, resin-coated glass beads, and sand, glass beads, ceramic particles having a surface coated with the grouting agent Preferably, as a method of injecting the grouting agent or the filling material into the reservoir, a chemical injection method of infiltrating the grouting agent into the gaps within the sand particles, and a high-pressure injection method of cutting the sand by a high-pressure jet flow and forcing the grouting agent or the filling material into the reservoir, are adopted.

Advantageous Effects of Invention

By artificially adhering the unsolidified or weakly solidified sand reservoir and constructing a grouting body having sufficient strength and good permeability around the mine well, the compaction of reservoir and the production of sand during the production of methane hydrate can be solved, and thus, it is possible to provide an innovative production technique of methane hydrate.

In addition, the grouted methane hydrate reservoir has properties similar to those of conventional petroleum oil and gas reservoirs, and can make the existing petroleum oil and gas development technologies to yield a maximum production, which is economically advantageous.

DESCRIPTION OF EMBODIMENTS

First Embodiment

Figure 1:
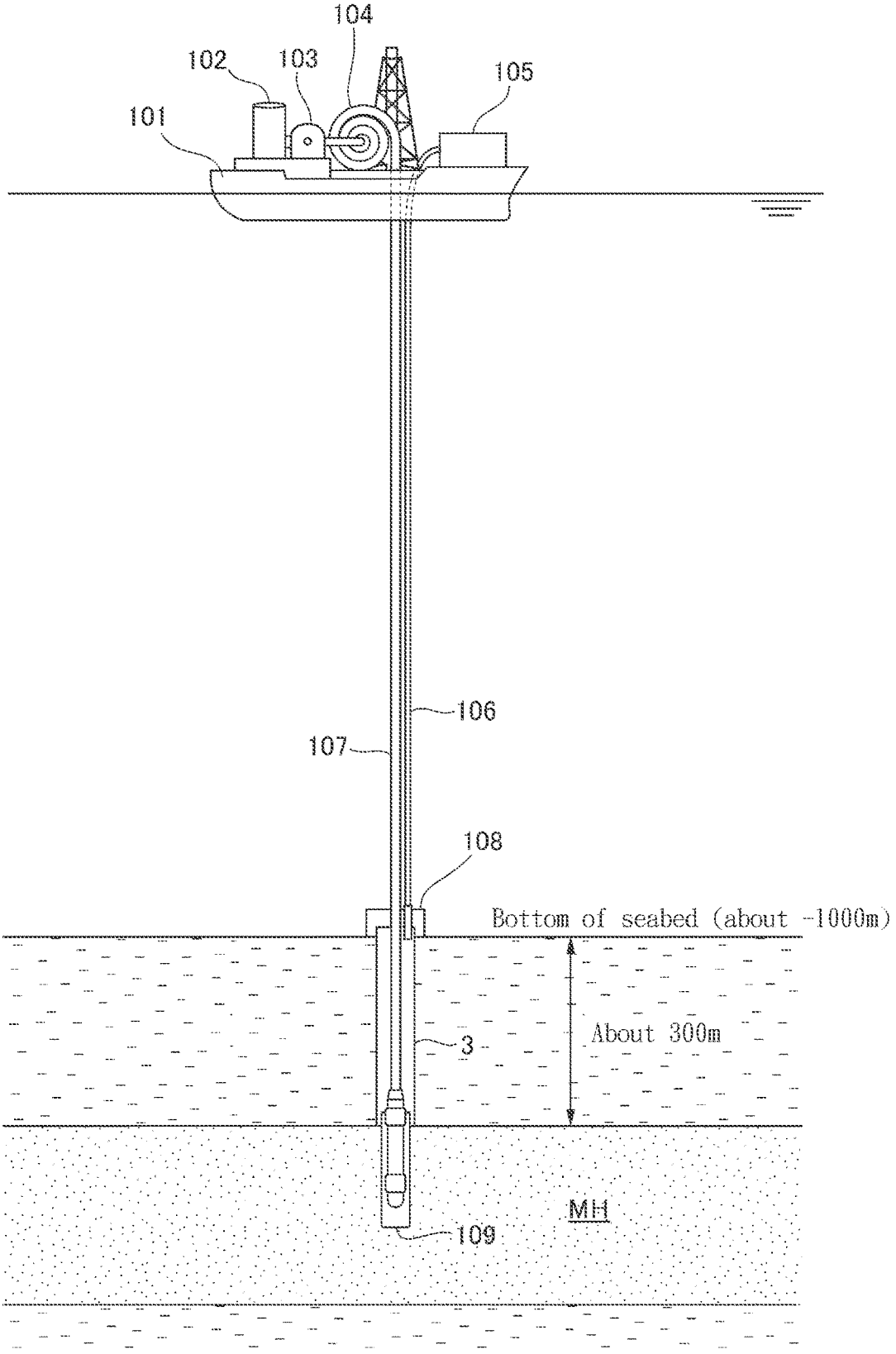
FIG. 1 illustrates a production method according to a first embodiment of the present invention.

FIG. 1 illustrates a production method according to a first embodiment of the present invention.

For example, methane hydrate exists in the subsea reservoir of the Nankai Trough nearby Japan. The bottom of the sea is assumed to be about 1000 m deep. In addition, there is a concentrated zone of methane hydrate in the sand reservoir MH about 300 m deeper than the subsea surface. This target reservoir MH is assumed to be the target reservoir to be developed, and the layer thickness thereof is assumed to be several tens of meters.

In the production of methane hydrate, as shown in FIG. 1, a mine well from the subsea to the target reservoir MH is drilled by a working ship 1. A BOP (Anti-spouting device) 108 is provided at a mine mouth, a casing 3 is provided in the mine, and cementing is applied to a gap between a mine wall and the casing. Further, at a specific depth corresponding to the target reservoir MH, a gunper hole penetrating the casing and the cementing portion is formed by gun perforation. Thus, the material exchange between the target reservoir MH and the mine becomes possible.

The working ship 1 is provided with a grouting agent tank 102, a pump 103, a winch 104, and a muddy water treatment device 105. The winch 104 winds and stores an injection hose 107, and can be extended and wound as needed. The injection hose 107 is used to feed the grouting agent G in the grouting agent tank 102. It is also possible to use a digging pipe to replace the hose, depending on working conditions.

On the other hand, a muddy water hose 106 is used for transporting the muddy water returned from the mine well to the working ship 1. The muddy water from the muddy water hose 106 is appropriately treated by the muddy water treatment device 105.

A mine injection device 109 is used for injecting the grouting agent into the target reservoir.

However, this is just an illustrative example. The present invention is not limited thereto, and the present invention can be applied to the subsea and reservoir with different depths or the target reservoir MH with different layer thicknesses. In addition, the casing may be not installed in the target reservoir MH, and it is possible to carry out other support measures on the mine wall or to produce in a bare mine. Furthermore, the method is applicable not only to the target reservoir MH of the subsea but also to the methane hydrate layer on the land.

Figure 2:
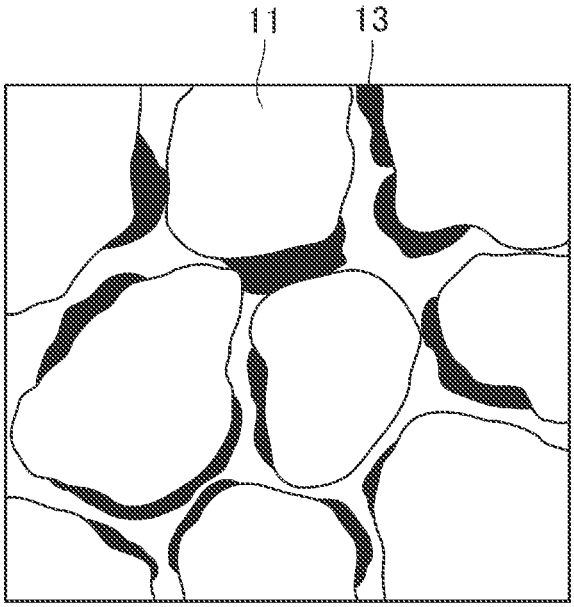
FIG. 2 illustrates a status of sand reservoir type methane hydrate existing in a reservoir.
Figure 2:
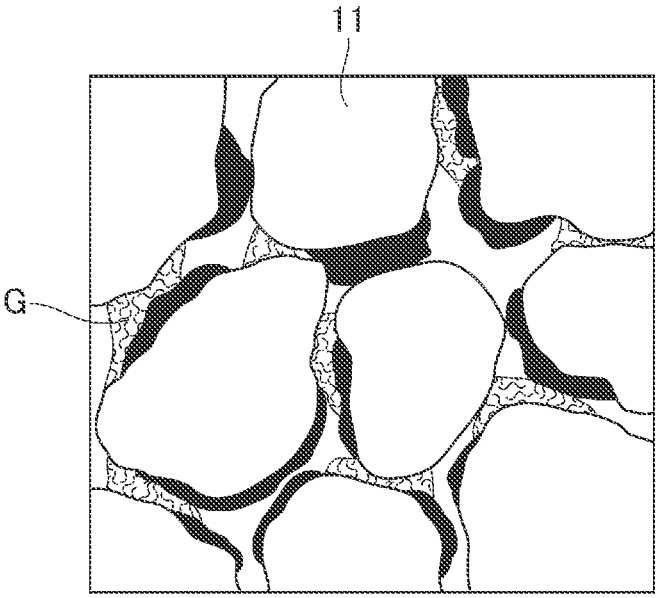

FIG. 2 illustrates a status of the target reservoir MH.

The target reservoir MH is a reservoir mainly composed of sand particles 11, and it is assumed that methane hydrate 11 exists in a gap within the sand particles 13. Here, the methane hydrate is in a solid state because it is in a stable region. The sand particles are firmly fixed to each other in the presence of solid methane hydrate.

In this status, since methane hydrate decomposes into water and methane gas when the pressure is lowered, methane gas can be produced from methane hydrate by the depressurization method.

However, if no countermeasure is taken in this status, the adhesion force within the sand particles will be deprived due to the decomposition of methane hydrate, and the fluidity is disadvantageously occurred in the sand particles. As a result, a large amount of sands 11 will flow out together with methane gas or water, which causes a serious production failure.

Therefore, there is a need for a method capable of preventing the outflow of the sands 11 within a range in which the permeability of the target reservoir MH does not largely decrease for the stable production of the methane hydrate.

Through the reservoir grouting as described in the present invention, a grouting agent capable of sufficiently fixing sand particles 11 is so injected into the porosity of the target reservoir MH as to artificially fix the sand particles. By controlling the injection conditions, the target reservoir MH after the reservoir grouting will have the permeability sufficient for the production of methane hydrate, as well as have a property that the fluidity of sand particles, the compaction of reservoir and the production of sand will not occur even if the methane hydrate is decomposed.

Figure 3:
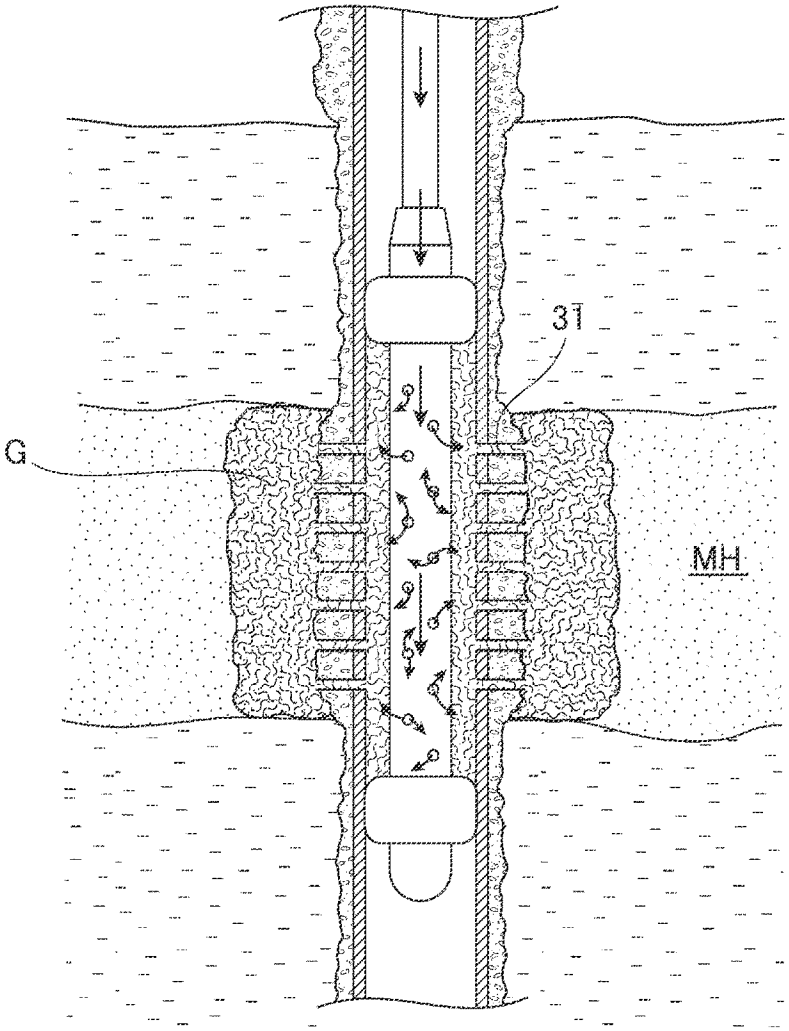
FIG. 3 is a conceptual diagram of an example of a mine injection device and an image of the injection of a grouting agent using the mine injection device.
Figure 3:
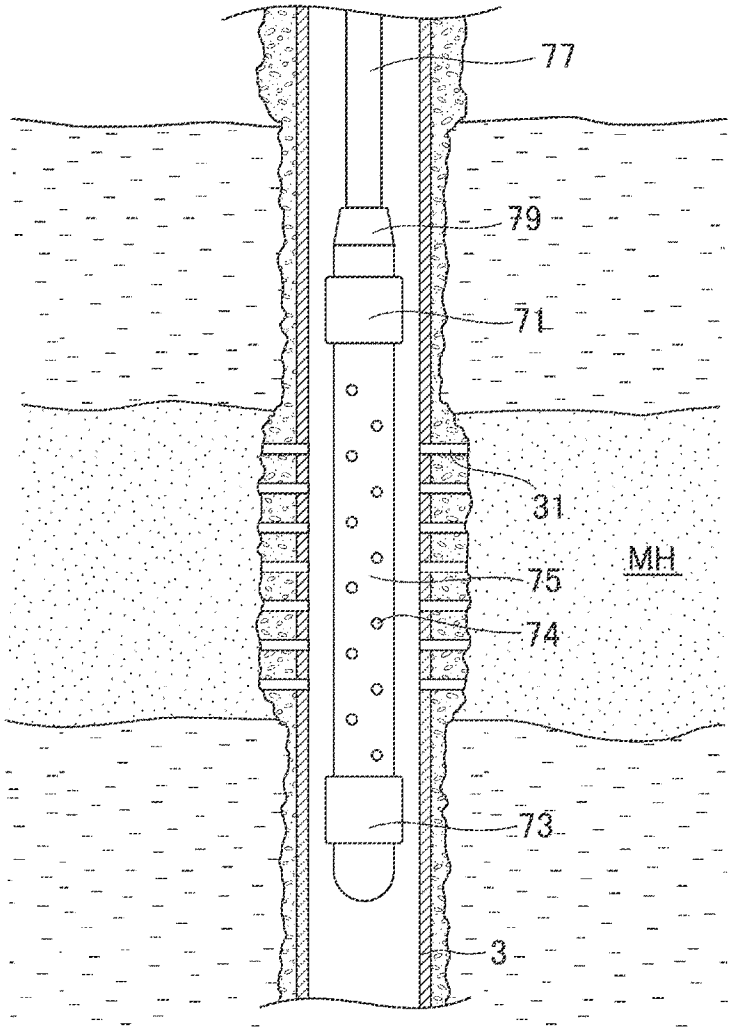

FIG. 3 illustrates the injection of the grouting agent G.

As shown in FIG. 3, the casing 3 is inserted into the mine. Cementing is applied between the mine wall and the casing 3. In the casing 3 and the cementing portion, a plurality of gunper holes 31 penetrating the inside of the casing and the target reservoir MH are formed. Through the gunper holes 31, material exchange between the reservoir and the inside of the casing (the fluid or solid particles) becomes possible.

The mine injection device 109 is provided with a body, a connection portion (hanging tool), an upper parker 71, and a lower parker 73, and is connected through a hose 77 to an on-ground device (or that on the ship). The body has a hollow cylindrical shape, and outflow holes for the grouting agent and the muddy water are provided on the wall surface. It should be noted that, depending on the working conditions, it is possible to use the digging pipe to replace the hose 77.

The injection of the grouting agent is carried out according to the following procedures. In addition, it may be carried out by different procedures depending on the site situation.

With the upper parker 71 and the lower parker 73 contracted, the mine injection device 109 is lowered to a predetermined depth.

The upper parker 71 and the lower parker 73 are inflated by hydraulic pressure or compressed gas and brought into closely contact with the inner wall of the casing 3.

From the on-ground device (or that on the ship), the grouting agent G is fed to the mine injection device through the hose (or the digging pipe) 77. The grouting agent G in the mine injection device is filled between the upper parker 71 and the lower parker 73 from the outflow holes, and is eventually injected into the target reservoir MH through the gunper holes 31.

After the gel time of the grouting agent G, the sand particles are fixed to each other via the solidified grouting agent G, and even if the methane hydrate is decomposed, the sands will not become fluidized.

Depending on the type of the grouting agent and the gel time, it may be solidified in the hose (or the digging pipe) 77 or the mine injection device 109, and the device may become unusable again. In this case, the muddy water is circulated through the hose (or the digging pipe) 77 after the injection of grouting agent is completed, and the remained grouting agent G in the device can be discharged.

Figure 4:
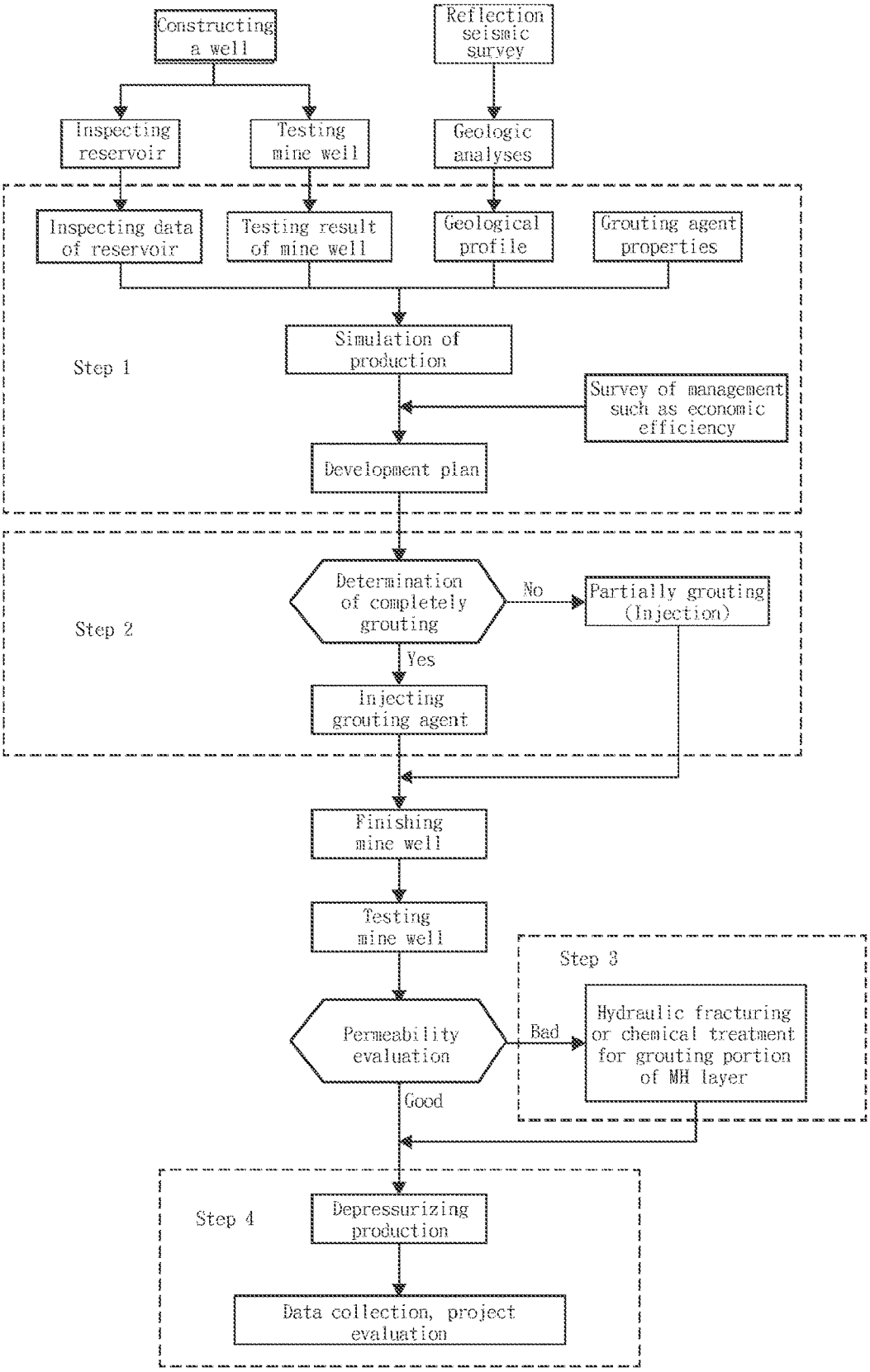
FIG. 4 is an example of production flows of methane hydrate by using the present invention.

FIG. 4 is an example of production flows of the present embodiment.

<Step 1 (Planning Process)>

In step 1, based on information, such as the geology and reservoir conditions, etc., of the development target, the type of the grouting agent to be injected, operation method and conditions, parameters, etc., must be calculated and determined in accordance with production simulation, economic evaluation, etc.

In the above planning process, it is necessary to know all or portions of the following information (a) to (e) as input data or judgment materials in advance.

(a) Reservoir structure, reservoir continuity, lithofacies, grain size, and estimated recoverable reserves.

(b) Shape, boundary, respective depth, thickness, porosity, permeability, saturation, temperature, pressure of the reservoir layer.

(c) Stable regions and decomposition conditions of methane hydrate.

(d) Applicable target, application condition, application limit of each grouting agent.

(e) Quantitative variation in temperature, pressure, porosity, saturation rate of each phase fluid, permeation rate, etc., in accompanied with the reaction mechanism of and the progress of the reaction of each grouting agent.

The above information (a) and (b) can be obtained from a methane hydrate development entity (petroleum oil company, etc.), and can also be explored and measured independently. Information (c) can be retrieved from existing literature. Information (d) can be obtained from the grouting agent manufacturer as well as in its own tests. Information (e) is one of the key points of the present invention and is established by an original experiment or simulation.

Furthermore, information other than the above information may be required depending on the individual project.

A plan for reservoir grouting can be formulated by using all or some of the above known information via production simulation or economic evaluation. In formulating the plan, some or all of the following items (a) to (n) shall be considered.

(a) Types of the grouting agents.

(b) Optimal grouting position and extent. The range is expressed as the grouting radius or the range of the grouting agent diffusing in the reservoir.

(c) Concentration, amount and compounding ratio of the grouting agent.

(d) The injection position, injection method, injection order, injection pressure, injection rate, etc of the grouting agent.

(e) Optimal gel time of the grouting agent.

(f) Types, concentration, amount to be used, timing of utilization, etc., of additives when used in combination with the grouting agent.

(g) Types, mass, concentration, chemical properties, wettability, etc., of the product originated from the grouting agent reaction.

(h) Permeability, porosity, pressure, temperature, strength, etc., of the target reservoir MH with the reservoir grouting.

(i) Variating trends in the amount, concentration, and viscosity of the remaining unreacted grouting agent.

(j) Composition, viscosity, pH, etc., of the grouted reservoir fluid.

(k) Operating method for discharging the unreacted grouting agent, density of muddy water, viscosity, muddy water circulation rate, etc.

(l) Necessity of recovery operation of permeability of target reservoir, type of operation, method, etc.

(m) Expected transition of each parameter representing the expected production of methane gas or water and the properties of the reservoir.

(n) Indices representing operating costs and economic efficiency under the above conditions and parameters.

Among the above, (a) types of the grouting agents is so selected that it can be injected into the reservoir through the production well and can sufficiently adhere the sand particles with weak solidification constituting the reservoir. In some cases, it is possible to change the grouting agent with a different grouting agent G at some point.

At present, it is envisioned that the grouting agent G will be a type of grouting agent, which is capable of adhering sand particles, via the formation of precipitates, polymers, and other solids, including cement, water glass, polymers (acrylamide, urea, urethane, etc.), or calcium carbonate.

However, it is not limited to the above type, and better ones are planned to develop in the future. At the time of development, the grouting agent is preferably selected on the viewpoint that it can be injected into the reservoir through the production well and that the weakly solidified sand particles that make up the reservoir can be sufficiently fixed.

<Step 2 (Reservoir Grouting Process)>

In step 2, the grouting agent is injected into the target reservoir MH by the method as shown in FIG. 3.

Figure 6:
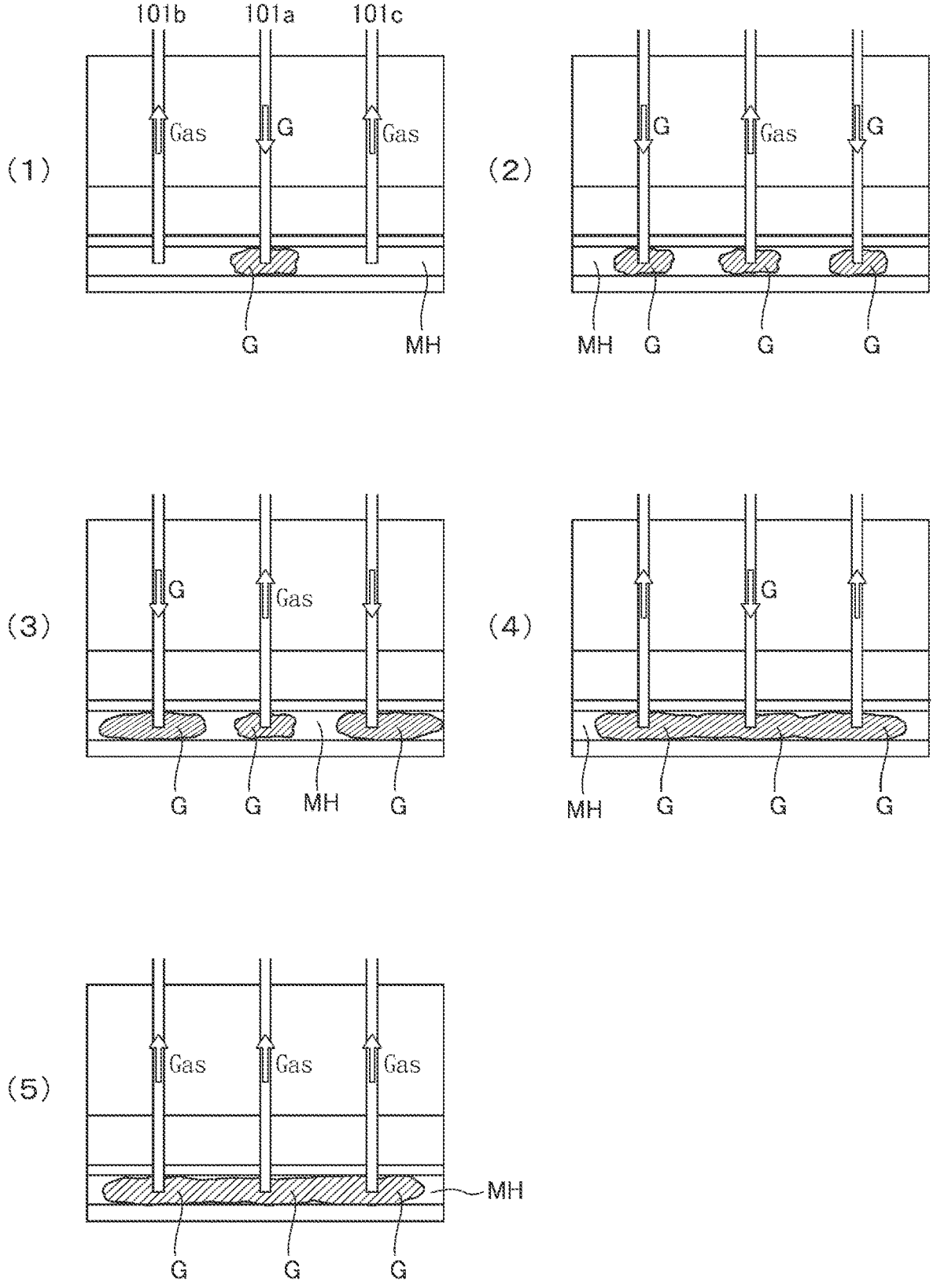
FIG. 6 is a conceptual diagram when the target reservoir is completely grouted by a plurality of horizontal mine wells.

In the injection of the grouting agent, there are a pattern for completely grouting the target reservoir MH and a pattern for partially grouting the target reservoir MH. The former (completely grouting) has the advantage that the target reservoir MH can be grouted by alternated injection and alternated production (as illustrated in FIG. 6) to have properties similar to those of conventional petroleum oil and gas reservoirs (the property of sand particles that are difficult to fluidize) and the existing petroleum oil and gas production technology can be utilized to the maximum extent.

Figure 7:
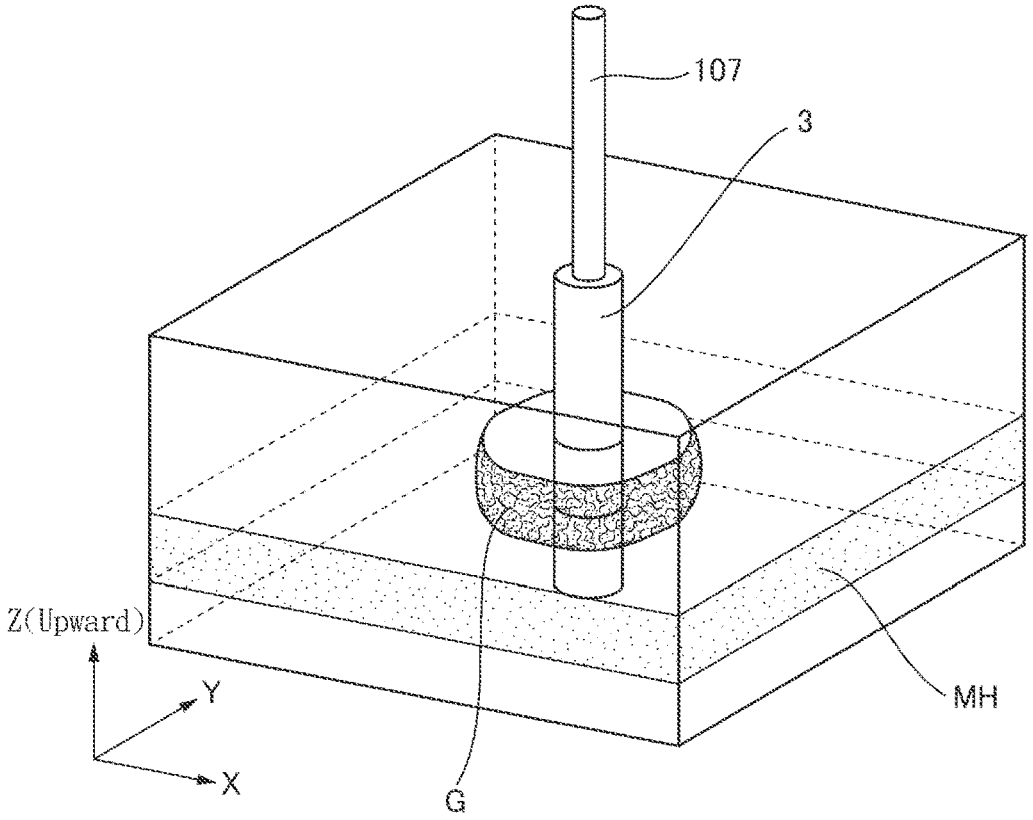
FIG. 7 is a conceptual diagram when the target reservoir is partially grouted by a single perpendicular mine well.
Figure 7:
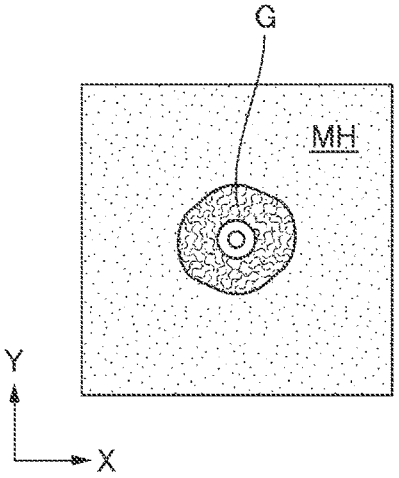
Figure 7:
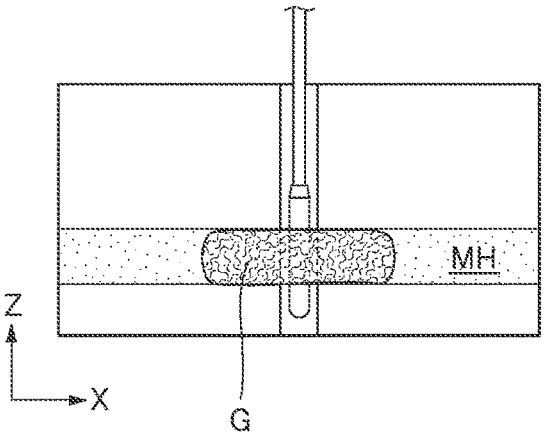

On the other hand, the latter (partially grouting) is a pattern (as illustrated in FIG. 7) in which the grouting agent is injected into a limited area around the mine well. The grouted reservoir acts like filters that block sand from flowing-in from the perimeter while merely allowing fluids, such as water or methane gas, to enter the mine. This pattern has the advantage of obtaining the effect of preventing production of sand as well as minimizing the grouted range (budget).

<Step 3 (Hydraulic Fracturing and Chemical Treatment Process)>

In Step 3, a mine well test is performed for the target reservoir MH as grouted in Step 2, and the permeability and production capacity of the reservoir are mainly evaluated. If necessary, the process is performed to improve the permeability of the target reservoir MH. For example, (a) hydraulic fracturing or (b) chemical treatment may be performed.

(a) Hydraulic fracturing is originally a technique for forming cracks (fracturing) in a shale layer with a low permeability mainly for the development of shale gas and shale petroleum oil, but in the present invention, this is carried out for the grouted portion where the permeation rate is significantly reduced due to the solidification of the grouting agent or the reaction product thereof.

On the other hand, in (b) the chemical treatment, hydrochloric acid or hydrofluoric acid is mainly used to remove fine particles and the like in the pores, thereby improving the permeability. In addition, in order to eliminate the decrease in permeability due to the excess reactants and by-products of the reaction in the reservoir grouting process, it is also possible to inject a chemical agent which reacts with the substance and urges the product to dissolve in a liquid, a gas or a fluid in the reservoir.

If the target reservoir MH as grouted in Step 2 has a sufficient permeability, this step may not be performed.

<Step 4 (Production Process)>

In Step 4, methane hydrate is decomposed from the target reservoir MH as grouted by the above steps by the depressurization method or the like to recover methane gas.

The effectiveness of the reservoir grouting or the initial production plan is evaluated from the results of actual gas production, etc., and it will contribute to the formulation of the subsequent production plan and the development and improvement of the grouting agent G.

Figure 5:
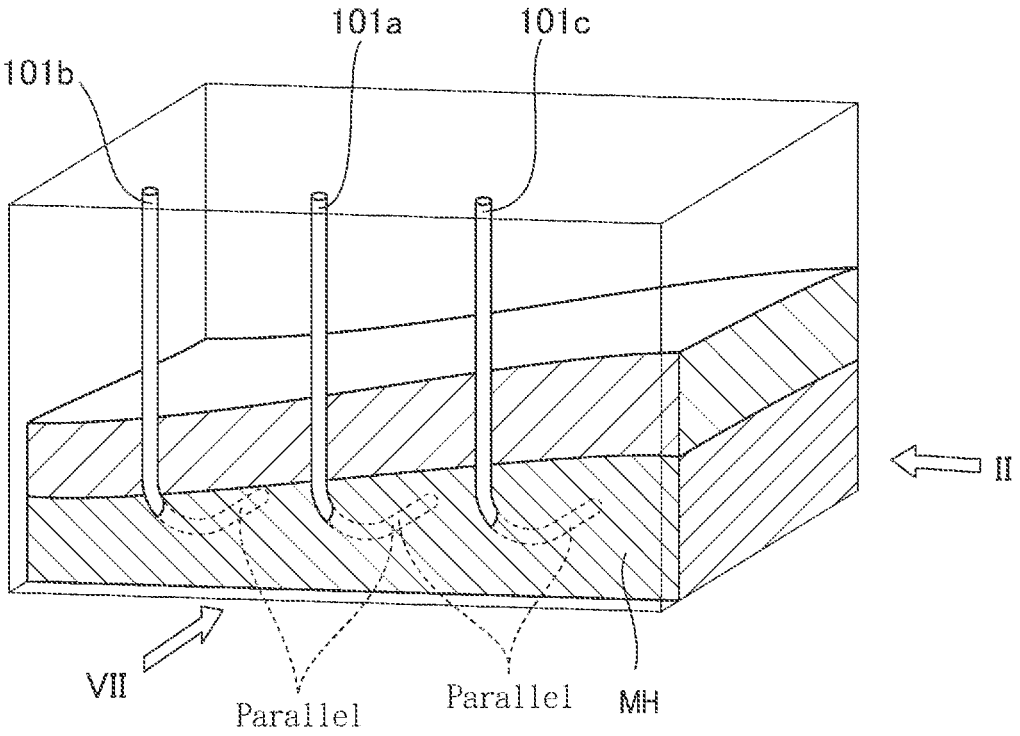
FIG. 5 is a conceptual diagram of horizontal mine wells.
Figure 5:
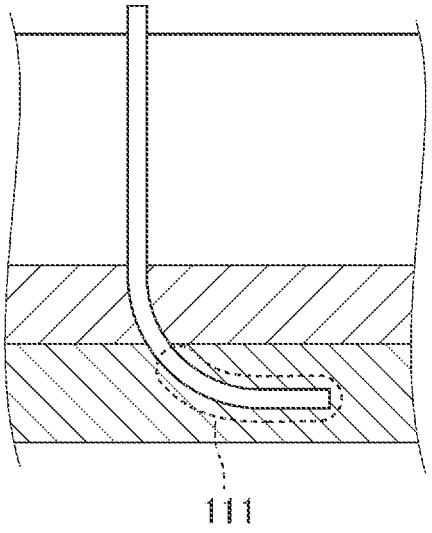

FIG. 5 is a conceptual diagram of utilizing a plurality of horizontal mine wells 101.

The mine well 101 is provided with a horizontal portion 111 extending in the target reservoir MH. The horizontal portion 111 is so provided with a large number of gunper holes 31, as shown in FIG. 3, as to allow material exchange of the grouting agent or products between the mine and the reservoir.

In order to ensure the grouting of reservoir and the maximization of production area, a plurality of wells 101 are drilled along a certain direction in the target reservoir MH as shown in FIG. 5(2) (first mine well: 101*a*, second mine well: 101*b* and third mine well: 101*c*).

In the actual development, the mine well arrangement is not limited as shown in the illustration, and can be determined according to the flow as shown in FIG. 4, based on geological conditions, reservoir layer conditions, economic evaluation, etc.

FIG. 6 is a conceptual diagram of a case where the target reservoir MH is completely grouted by alternating injection and alternating production by utilizing a plurality of horizontal mine wells.

FIG. 6(1) is an explanatory diagram of the first stage of alternating injection.

Depending on the conditions of the reservoir layer, the mine wells 101 are alternately divided into one group of production wells and the other group of injection wells.

While injecting the grouting agent G from the first mine well 101*a*, methane gas is produced from the second mine well 101*b* and the third mine well 101*c* by the depressurization method.

FIG. 6(2) is an explanatory diagram of the second stage of alternating injection.

As shown in FIG. 6(1), if the production is continued from the second mine well 101*b* and the third mine well 101*c*, there is a risk of the compaction of reservoir and the production of sand. Therefore, when methane hydrate is decomposed to a certain amount, the production will migrate to the second stage as shown in FIG. 6(2).

Specifically, the first mine well 101*a* will be switched to the methane gas production well, and the second mine well 101*b* and the third mine well 101*c* will be switched to the injection mine well of the grouting agent G. As a result, it is possible to improve both groups of mine wells uniformly and stably to some extent without the compaction of reservoir and the production of sand.

FIG. 6(3) is an explanatory diagram of the third stage of alternating injection.

When the grouting of FIG. 6 (2) is proceeded, as shown in FIG. 6(3), the second mine well 101*b* and the third mine well 101*c* can be proceeded to a grouting status exceeding the first mine well 101*a* of FIG. 6(1).

FIG. 6(4) is an explanatory diagram of the fourth stage of alternating injection.

After the methane hydrate is decomposed to some extent, the first mine well 101*a* will be switched to the injection well again as shown in FIG. 6(4) for injecting the grouting agent. On the other hand, the second mine well 101*b* and the third mine well 101*b* will be switched to production wells again. In this way, alternating injection and alternating production will be executed until the target reservoir MH is completely grouted.

FIG. 6(5) is an explanatory diagram of the fifth stage of alternating injection.

When proceeding to the status as shown in FIG. 6(4), the target reservoir MH will be completely grouted and have properties similar to those of ordinary petroleum oil and gas reservoir layers. Since the compaction of reservoir and the production of sand will be less likely to occur, methane gas can be produced via all of the first mine well 101*a*, the second mine well 101*b*, and the third mine well 101*c*.

With the above approach, it is possible to have a promoted grouting by alternating injection, while alternating production can be achieved, and it is possible to achieve grouting by utilizing the horizontal mine wells and aim to maximize the production area and improve the recovery rate.

Furthermore, FIG. 6 is only an example. The number of mine wells, the shape, and the number of alternations of the grouting agent injection can be changed according to the site conditions. It is also possible to use an enhanced recovery method, which is different from the depressurization method.

FIG. 7 is an explanatory diagram when a partially grouting is applied to the target reservoir MH by a single perpendicular mine well.

At the appropriate depth of the vertical well (101) throughout the target reservoir MH, the injection operation of the grouting agent is carried out using the mine injection device as shown in FIG. 3. At this time, the grouting agent diffuses around the mine well of the target reservoir MH with permeability, and the sand particles are artificially fixed according to the illustrated principle as shown in FIG. 2, so that the compaction of reservoir or production of sand will not occur during production. After that, hydraulic fracturing (fracturing) and chemical treatment are carried out on the grouting body, if necessary, so as to execute the operation of improving the permeability of the reservoir grouted portion. Thus, a grouted portion having sufficient permeability and strength can be constructed.

The grouted portion acts like filters that block sand from flowing-in from the perimeter while merely allowing fluids, such as water or methane gas, to enter the mine. The effect of preventing the production of sand due to reservoir grouting only executed around the mine well can be achieved, while minimizing the budget of executing grouting reservoir grouting.

Second Embodiment

In the second embodiment of the present invention, a porous grouting body is formed of the filling material in the target reservoir around the mine well, and it can prevent the production of sand in the mine during production of methane hydrate.

Figure 8:
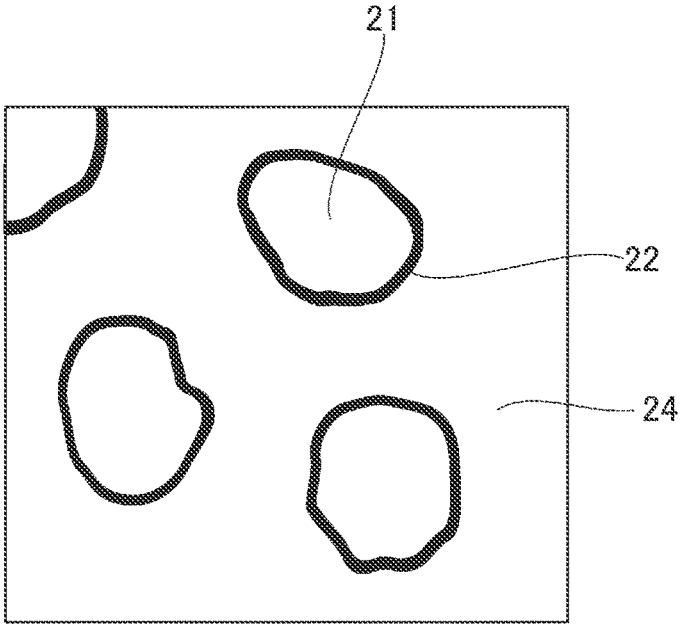
FIG. 8 is a conceptual diagram of constructing a porous grouting body using a filling material according to a second embodiment of the present invention.
Figure 8:
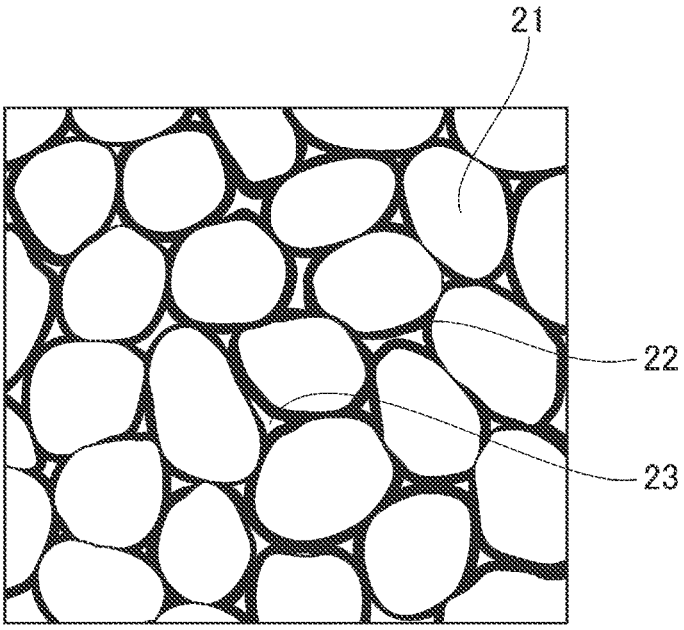

FIG. 8 is a conceptual diagram of constructing the porous grouting body using the filling material according to a second embodiment of the present invention.

The filling material as described in the present invention is a material prepared by coating the surface of the particles 21 with an adhesion agent 22. Particles 21 are silica sand, ceramic, or glass beads with a diameter of 0.1 mm to 10 mm. The adhesion agent 22 is in its solid state at room temperature and in a dry environment, but it has a property of fixing the particles 21 through generation of a solid substance, such as calcium carbonate and a polymer substance, by a chemical reaction resulted from a hot water, a combination agent or a catalyst.

At the time of filling, the filling material is dispersed in a liquid 24 serving as the transporting medium, and liquid-like or slurry-like injection material with an appropriate viscosity is constructed. The injection material is fed into the mine by the mine injection device and injected into the cavity of the target reservoir. The injected injection material can so fill the cavity that the liquid 24 penetrates into the target reservoir and the remaining filling material can adhere to the grains. The filling rate of the cavity can be estimated from the injection amount of the injection material, injection rate, injection pressure, etc.

Once the cavity is fully filled, a hot water, the combination agent or the catalyst is injected into the reservoir to facilitate the chemical reaction by the adhesion agent 22. Thus, a chemical reaction is originated by the adhesion agent 22 to form a solid material, and the particles 21 can be fixed. Between the adhered particles 21, there is a pore space 23 through which fluid can pass. Thus, the porous grouting body having sufficient strength and good permeability can be prepared, and stable gas production can be realized while preventing the production of sand.

Preferably, the filling material is selected from those capable of forming a grouting body having sufficient strength and good permeability in a reservoir environment where methane hydrate exists. For example, it is selected from resin-coated sand (resin-coated sand), resin-coated ceramic particles, resin-coated glass beads, and sand, glass beads or ceramic particles having a surface coated with the above-mentioned grouting agent.

Preferably, the liquid 24, as the transporting medium, can adopt muddy water or other liquid, whose specific gravity can be adjusted to balance the reservoir pressure and viscosity can be so adjusted that the dispersed filling material does not readily precipitate.

Figure 9:
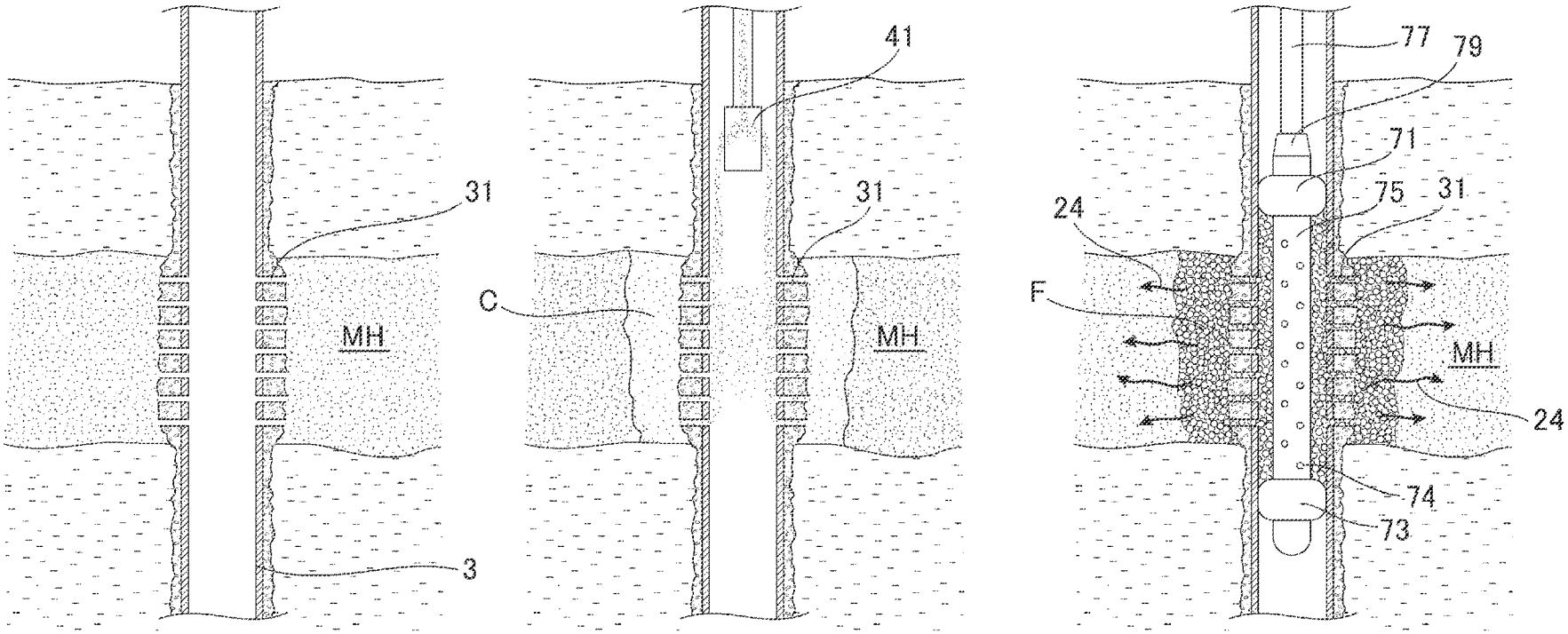
FIG. 9 is an illustrative diagram of a method for constructing a porous grouting body around a mine well according to the second embodiment of the present invention.

FIG. 9 is an illustrative diagram of a method for constructing a grouting body around a mine well according to the second embodiment of the present invention.

As shown in FIG. 9, the mine well is drilled to the target reservoir MH. A casing 3 is installed in the mine, and cementing is applied between the mine wall and the casing 3. In the casing 3 and the cementing portion, a plurality of gunper holes 31 penetrating the inside of the casing and the target reservoir MH are formed. Through the gunper holes 31, material exchange between the reservoir and the inside of the casing (the fluid or solid particles) becomes possible.

The preparation of the grouting body is carried out according to the following procedures.

- Depressurization by a submersible pump (ESP pump) 41 is performed to decompose methane hydrate contained in the target reservoir MH. In accompanied with the decomposition of methane hydrate, the adhesion force of sand particles, those constitute the reservoir, will be deprived, and the sand particles will be transported into the mine in accompanied with the production of water, and are discharged to the ground (or the ship) by the submersible pump 41. The discharge of the sand will result in a cavity C filled with the reservoir fluid in the target reservoir MH around the mine well.
- On the ground (or the ship), the emission rate or cumulative emission amount of sand and water will be monitored, and the estimated size (height, radius, etc.) of the cavities formed around the mine well will be monitored.
- If the estimated sizes of the cavities reach the planned value, the sand discharge operation will be stopped and the submerged pump 41 will be recovered to the ground (or the ship).
- Similar to the method for injecting the grouting agent in the first embodiment by using the mine injection device of FIG. 3, the injection material and the hot water, the combination agent or the catalyst for facilitating the solidification of the filling material F will be injected into the cavity resulted from the production of sand.
- Once the injection operation is completed, water or muddy water is circulated through the hose (or the digging pipe) 77 to discharge the injection material remaining in the injection device.
- Recover the mine injection device to the ground (or the ship).

Thus, the filling material F can be injected into the target reservoir around the mine well. The filling material F will become a porous grouting body having sufficient strength and good permeability after its solidification, and stable gas production can be realized while preventing the production of sand.

As a method for intentionally occurring the production of sand, methane hydrate may be decomposed by hydrothermal circulation or by input of chemical substances such as inhibitors, other than depressurization by the submersible pump. Further, as a method for forming the cavity in the target reservoir, other than the method for decomposing the methane hydrate, reservoir cutting by high pressure fluid injection or reservoir cutting by a machine fed into the mine may be used. Furthermore, as a method for injecting the filling material into the reservoir cavity, other devices or methods may be used in addition to the mine injection device shown in FIG. 3.

Having such an embodiment makes it possible to prevent excessive production of sand during the production of methane hydrate.

The structure, system, program, material, connection relationship of parts, chemical substance to be used, and the like of the present invention can be variously modified without violating the spirits of the present invention.

Materials such as metal, plastic, composite material, ceramic and concrete can be arbitrarily selected.

For example, two or more parts can be combined into single one, or conversely, one part can be composed of two or more parts and connected to each other. In addition, as to the grouting agent, the grouting agent may be so blended with an additive (adsorption accelerator, surfactant, catalyst, etc.) as to allow the grouting agent to function well, or the improver may be so mixed with gas bubbles, such as $N_2$ or $CO_2$, or microvalves, as to allow the grouted reservoir to have a permanent permeability.

Further, the grouting may be performed not only at one time for one reservoir but also at a plurality of positions in multiple stages. On the contrary, it is also possible to perform the grouting for a plurality of thin reservoirs at once.

Moreover, the above-described embodiment is mere one of the best embodiments at present.

Further, the control and the like may be controlled by a control part of a drillship or a ground site, or may be controlled by a control part installed in the sea, a mine mouth, or in a mine.

Further, the order of the processes can be appropriately changed as long as a predetermined effect can be achieved.

REFERENCE SIGNS LIST

1 Working ship
11 Sand particles
13 Methane hydrate
101 Mine well
102 Grouting agent tank
103 Pump
104 Winch
105 Muddy water treatment device
106 Muddy water hose
107 Injection hose
108 BOP (Anti-spouting device)
109 Mine injection device
111 Horizontal portion
21 Particle
22 Adhesion agent
23 Pore space
24 Liquid
3 Casing
31 Gunper hole
41 Submersible pump (ESP pump)
7 Mine injection device
71 Upper parker
73 Lower parker
74 Hole
75 Body of mine injection device
77 Hose
79 Connection portion
C Cavity
F Filling material
MH Target reservoir
G Grouting agent

The invention claimed is:

1. A methane hydrate production method comprising a step of:

performing a reservoir grouting process, comprising:

drilling a mine well to a target reservoir and forming a space in the mine well;

wherein the space allows mine injection or production devices to be utilized;

installing a mine injection device in the space; and performing an injection by means of the mine injection device, wherein the step of performing the injection is selected from:

(1) injecting a grouting agent into a reservoir under permafrost on the land or a subsea reservoir for targeting methane hydrate existing within sand particles of the target reservoir; and (2) injecting a filling material out of the space and into cavities naturally or artificially occurred in a reservoir under permafrost on the land or a subsea reservoir for targeting methane hydrate existing within sand particles of the target reservoir; and enabling a grouting body to be constructed;

wherein the injected grouting agent or filling material in the space further exits from the space through a plurality of gun perforations or sand faces.

2. The methane hydrate production method according to claim 1, further comprising:

performing a planning process prior to the reservoir grouting process for calculating and determining factors including: a type of the injected grouting agent or the filling material, operation methods and conditions, various parameters; and injecting the grouting agent or the filling material based on the conditions as determined in the planning process.

3. The methane hydrate production method according to claim 2, further comprising:

performing a production process after the reservoir grouting process, for recovering methane gas by decomposing methane hydrate into methane gas and water from the reservoir that has undergone a reservoir grouting.

4. The methane hydrate production method according to claim 3, further comprising performing a hydraulic fracturing or a chemical treatment process after the reservoir grouting process, for improving the permeation rate of the reservoir that has undergone the reservoir grouting.

5. The methane hydrate production method according to claim 2, wherein at least one type of the grouting agent or the filling material is determined in the planning process.

6. The methane hydrate production method according to claim 5, wherein the grouting agent is so selected that it is able to be injected into the reservoir through a production well and to sufficiently adhere the sand particles constituting the reservoir with weak solidification.

7. The methane hydrate production method according to claim 6, wherein the grouting agent is a type of grouting agent capable of adhering sand particles via a formation of precipitates, polymers, and other solids, and includes cement, water glass, polymers or calcium carbonate.

8. The methane hydrate production method according to claim 2, wherein the polymers include acrylamide type, epoxy resin, phenol resin, furan resin, urea type, and urethane type.

9. The methane hydrate production method according to claim 2, further comprising a step of performing a simulation of a behavior of the reservoir with the determined conditions of injecting the grouting agent or the filling material.

10. The methane hydrate production method according to claim 2, further comprising a step of performing a simulation of a production of methane gas from the reservoir and performing a simulation of the reservoir that has undergone the grouting; wherein the reservoir is injected with the grouting agent based on the determined conditions before the reservoir undergoes the grouting.

11. The methane hydrate production method according to claim 2, further comprising a step of performing a simulation of a production of methane gas from the reservoir and performing a simulation of the reservoir that has undergone the grouting; wherein the reservoir is injected with the filling material based on the determined conditions before the reservoir undergoes the grouting.

12. The methane hydrate production method according to claim 1, wherein the filling material is selected from resin-coated sand, resin-coated ceramic particles, resin-coated glass beads, and sand, glass beads, ceramic particles or particulate substances having a surface coated with a grouting agent; wherein the grouting agent is the type of grouting agent capable of adhering sand particles via a formation of precipitates, polymers, and other solids, and includes cement, water glass, polymers or calcium carbonate.

13. The methane hydrate production method according to claim 1, further comprising:

providing a casing in the mine well, wherein an inner wall of the casing forms the space allowing the mine injection device to be disposed;

making the plurality of gun perforations further penetrating the casing.

14. The methane hydrate production method according to claim 13, further comprising:

applying cementing between a wall of the mine well and the casing; and forming the plurality of gun perforations further penetrating the cement.

* * * * *